US009230384B2

(12) United States Patent
Gawel et al.

(10) Patent No.: US 9,230,384 B2
(45) **Date of Patent: *Jan. 5, 2016**

(54) DEVICE FOR INSERTING BANK NOTES INTO A BILL ACCEPTOR

(71) Applicant: NOVOMATIC AG, Gumpoldskirchen (AT)

(72) Inventors: Marek Gawel, Traiskirchen (AT); Heinz Fridrich, Leobersdorf (AT)

(73) Assignee: NOVOMATIC AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/457,263

(22) Filed: Aug. 12, 2014

(65) Prior Publication Data

US 2015/0027848 A1 Jan. 29, 2015

Related U.S. Application Data

(63) Continuation of application No. 13/818,665, filed as application No. PCT/EP2011/003875 on Aug. 2, 2011, now Pat. No. 8,827,264.

(30) Foreign Application Priority Data

Aug. 25, 2010 (EP) ..... 10008842

(51) Int. Cl.

| | |
|---|---|
| ***G07F 7/04*** | (2006.01) |
| ***G07D 11/00*** | (2006.01) |
| ***B65H 1/04*** | (2006.01) |

(52) U.S. Cl.

CPC ..... *G07D 11/0018* (2013.01); *B65H 1/04* (2013.01); *G07F 7/04* (2013.01)

(58) Field of Classification Search

CPC ..... G07D 11/0018; B65H 1/00; B65H 1/04; G07F 7/04

USPC ..... 271/162, 171; 194/344, 350, 351; 235/379; 902/9, 12–15, 17, 18

See application file for complete search history.

(56) References Cited

U.S. PATENT DOCUMENTS

| | | | |
|---|---|---|---|
| 5,398,609 | A | 3/1995 | Stiel |
| 7,530,440 | B2 | 5/2009 | Nagano |

(Continued)

FOREIGN PATENT DOCUMENTS

| | | |
|---|---|---|
| EP | 1416446 | 5/2004 |
| EP | 2015259 | 1/2009 |

OTHER PUBLICATIONS

International Search Report for PCT/EP2011/003875, English translation attached to original, Both completed by the European Patent Office on Nov. 9, 2011, All together 5 Pages.

*Primary Examiner* — Jeremy R Severson
(74) *Attorney, Agent, or Firm* — Brooks Kushman P.C.

(57) ABSTRACT

A device for inserting bank notes into a bank note processing device. The bank note processing device has a main body, a support surface for supporting a bank note to be inserted on a flat side, and at least one lateral positioning edge for laterally positioning the slot on the bank note processing device and/or for connecting the slot to the bank processing device in an accurately fitting manner. The device for inserting bank notes into a bank note processing device is characterized by a setting mechanism for variably setting the position of the positioning edge transversely to the insertion direction of the bank note through the slot.

16 Claims, 4 Drawing Sheets

(56) References Cited

U.S. PATENT DOCUMENTS 8,827,264 B2 * 9/2014 Gawel et al. ..... 271/171
2004/0222296 A1 11/2004 Douglass et al.
2006/0081441 A1 4/2006 Vysma et al.

* cited by examiner

CUT A-A

CUT B-B

DEVICE FOR INSERTING BANK NOTES INTO A BILL ACCEPTOR

CROSS-REFERENCE TO RELATED APPLICATION

This application is a continuation of U.S. application Ser. No. 13/818,665 filed Feb. 23, 2013, which is a U.S. national phase of PCT application No. PCT/EP2011/003875 filed on Aug. 2, 2011, which claims priority to European patent application No. 10008842.6 filed on Aug. 25, 2010, the disclosures of which are incorporated in their entirety by reference herein.

TECHNICAL FIELD

The present invention relate to a device for inserting bank notes into a bill acceptor that comprises a main body, a supporting surface for supporting a bank note to be inserted flat, and at least one lateral positioning flank for laterally positioning and/or connecting the feeder to the bill acceptor so that it fits precisely. In particular, the device is a feeder.

BACKGROUND

In the case of cash gaming machines, it is customary to integrate a bill acceptor into the gaming machine, said bill acceptor checking that the bank notes are genuine for example, reading the value of the bank notes, accepting the bank notes and depositing them in a storage unit, or alternatively dispensing bank notes as winnings, or processing them in another way. In order to be able to better insert the bank notes into such a bill acceptor, as a rule feeders are attached in front of the input slot of the bill acceptors and make it easier to thread the bank notes in and help to insert them. In particular, such feeders make it easier to precisely position the bank notes to be inserted. For this purpose, a supporting surface is provided for supporting the bank note and is usually bordered on both sides by positioning flanks in order to orient the bank notes transversely to the direction of insertion, centrally with respect to the insertion slot or at a predetermined insertion edge.

Different feeders or different bill acceptors need to be used, depending on what type of bank notes, i.e. for example dollars or euros, rubles or yen, the bill acceptor is designed for, in order to place the respective bank notes precisely in the desired position relative to the entry slot of the bill acceptor and to be able to process them. This is unproblematic per se as long as the feeder is attached to the respective bill acceptor, with the result that each bill acceptor has its own feeder.

However, in the case of gaming machines it is advantageous to arrange and secure the bill acceptor inside the housing of the gaming machine, whilst the feeder for inserting the bank notes is advantageously provided on a housing wall or is incorporated into the housing wall, in order to protect the bill acceptor situated behind the housing wall from being manipulated. Said feeder can hereby advantageously be integrated into the machine door or a door-like housing part, so that the feeder is hinged away from the bill acceptor when the machine door hinges open and comes to lie in front of the bill acceptor so that it fits precisely when the door is closed.

However, because such gaming machines can contain different bill acceptors for different countries, integrating the feeder into a machine housing part means that it is not possible to use a single machine housing and different versions need to be manufactured and made available depending on the feeder required. However, the approach of designing separate feeders for different bill acceptors and integrating them into the corresponding gaming machine housing entails considerable expenditure on construction and manufacturing and has corresponding costs associated with it.

US 2004/0222296 discloses an ATM with a front panel that is provided with a feeder through which an acceptor arranged behind the front panel can be accessed. The internal width of the feeder can be adjusted by transversely adjustable side flank parts that are guided on the rear of the front panel in elongated guides.

Furthermore, EP 14 16 446 discloses a gaming machine that has a feeder for feeding in bank notes provided on its front panel, said feeder having a supporting surface, in the form of a grid, for supporting the bank notes to be inserted flat.

The object of the present invention is therefore to provide an improved device of the type mentioned at the beginning that obviates the disadvantages of the prior art and advantageously develops the latter. In particular, the invention is to provide a universal feeder that can be used for a large number of different bill acceptors, wherein the positioning flanks of the feeder can be finely adjusted transversely to the direction of insertion of the bank notes and can be easily secured in the desired position.

SUMMARY

It is thus proposed to design the at least one lateral positioning or connecting flank of the feeder so that it is adjustable or to make adjustable the supporting contour defined by the positioning flank that determines the connecting contour for the bill acceptor. The feeder can be adapted for different bill acceptors by transversely displacing the supporting contour defined by the positioning flank. According to the invention, setting means are provided for variably setting the position of the positioning flank transversely to the direction of insertion of the bank note. It is here particularly advantageous if the setting means comprise an adapter element that is mounted adjustably on a mounting surface, in the form of a tapering face, of the main body and can be adjusted by being shifted on the tapering face transversely to the direction of insertion. The tapering face converts an adjusting motion of the adapter element on the tapering face into an advancing motion transverse to the direction of insertion of the bank notes. The adapter element can hereby be adjusted on the tapering face with respect to the depth of the feeder, i.e. more or less parallel to the direction of insertion of the bank notes but also adjusted in a direction more or less perpendicular to the supporting surface for supporting the bank notes flat or in a direction that is superimposed on these two directions, in order to obtain the desired advancing motion transverse to the direction of insertion of the bank notes. The positioning flanks can hereby be set to different widths for bill acceptors of different widths, whereby the feeder can be used universally for different bill acceptors.

As a development of the invention, the feeder advantageously has a pair of lateral positioning flanks that are arranged adjoining the supporting surface on opposite sides of the supporting surface, wherein the internal width between the positioning flanks can be adjusted by the abovementioned setting means. In principle, it can hereby be sufficient to design only one of the positioning flanks so that it can be adjusted in said manner, which can be provided in particular for bill acceptors that do not have a centrally located insertion point for the bank notes and instead have an input to the left or right, aligned to a determined entry contour, irrespective of the width of the bank notes. As a result, the feeder can in each case be adapted to the lateral entrance required by the respective bill acceptor and/or to the relative position of the feeder and bill acceptor.

However, as a development of the invention, the setting means of said type are preferably associated with both lateral positioning flanks so that each of the two lateral positioning flanks can be adjusted with respect to the position of their connecting or supporting contour.

According to an advantageous embodiment of the invention, said setting means comprise a preferably lamellar adapter element that can be placed on a preferably rigid body or base part of the respective positioning flank. The placing of said adapter element as it were doubles or thickens the positioning flank so that the internal width of the feeder tapers.

In order to able to achieve different feeder widths or set different positions of the flank contours, it can hereby be provided that different adapter elements are used interchangeably that have different geometries or a different number of adapter elements having the same or different geometries are used, i.e. one, two or more adapter elements are applied, one on top of the other, to the main body of the positioning flank, as required.

It is advantageously provided that the adapter element can be adjusted transversely to said direction of insertion of the bank notes and can be mounted at different points on said body part of the positioning flank so that different settings for the positioning flank can be achieved using the same adapter element. In particular, said adapter element can be adjustably mounted on said body part in such a way that, when the adapter element is adjusted, said adapter element undergoes a motion component parallel to the supporting surface and transverse to the direction of insertion of the bank notes so that the width of the insertion slot or the internal width of the feeder is changed or the respective supporting contour is adjusted correspondingly.

Said adapter element can have a preferably flat mounting surface by means of which the adapter element can be mounted on a mounting surface formed on the main body of the positioning flank, wherein said mounting surface on the main body is advantageously inclined at an acute angle relative to the direction of insertion of the bank notes through the feeder and/or to a perpendicular to the supporting surface of the feeder, so that the adapter element undergoes an adjustment transverse to the direction of insertion as a result of being shifted on said inclined mounting surface. By virtue of such a mounting surface that acts as a tapering face, the position of the adapter element can be precisely and finely adjusted, and hence the position of the supporting contour for the bill acceptor or the bank note to be inserted, simply by the adapter element being displaced on the mounting surface of the body part of the positioning flank. Depending on the size of the angle of inclination, it is possible to convert such a displacement motion into a transverse motion to a greater or lesser extent. A good compromise between a sufficient adjustment travel, on the one hand, and a sufficiently fine setting, on the other hand, can be achieved in a development of the invention by an angle of inclination of approximately 5° to 30°, preferably 10° to 20° being provided.

The tapering face on which the adapter element can be displaced or adjusted can in particular be oriented upright relative to the supporting surface for supporting the bank notes flat and can be inclined at an acute angle to the direction of insertion of the bank notes preferably in such a way that the tapering face is widened in the direction of insertion or becomes wider further down inside the feeder so that the internal width of the feeder can be reduced when the adapter element is shifted on the tapering face counter to the direction of insertion of the bank note and toward the front side. Alternatively or additionally, said tapering face can also be inclined at an acute angle with respect to a perpendicular to the supporting surface for sup-porting the bank notes flat, i.e. does not sit exactly perpendicularly on said supporting surface, so that the internal width of the feeder can be adjusted by setting the adapter element at a higher or lower point.

In order to prevent an undesired adjustment of the adapter element and make it difficult to do, as a development of the invention the adapter element and/or the mounting surface formed on the main body can advantageously be provided with a surface profiling that holds in position the adapter element placed on the mounting surface without any excessive contact force. Said surface profiling can hereby have a fundamentally different design and consist, for example, of ribs or a granular coating like sandpaper. However, the surface profiling preferably has a structure that is oriented in a certain direction. In particular, the surface profiling can take the form of corrugations or teeth, wherein the corrugations or teeth that preferably have a linear design advantageously run in a direction that generates greater resistance to slipping in the direction of the predetermined ability of the adapter element to shift on the mounting surface than to slipping transversely to this direction. Therefore, if, for example, the adapter element is shifted downward on the positioning flank in order to achieve the desired transverse adjustment, the corrugations or teeth can run horizontally in order to prevent undesired slipping downward or upward and hence undesired transverse adjustment.

Different types of fixing elements or means can be provided to fix the adapter element in the respective desired position. According to an advantageous embodiment of the invention, a tensioning element, preferably in the form of a screw, can be provided to clamp the adapter element on the main body of the positioning flank, wherein said tensioning element can advantageously be received in different fashions in an elongated hole in the adapter element and/or the main body in order to enable the adapter element to be shifted without the tensioning element being slackened off completely. Said tensioning element need only be slackened off a little to allow the adapter element to be displaced and tightened up again as soon as the adapter element has reached the desired position.

As an alternative to or in addition to such a tensioning element, interlocking retaining means can also be provided to fix the adapter element in place. For example, a locking means, for example in the form of a clip closure, can be provided on the spacer element and/or the main body of the positioning flank in order to be able to lock the adapter element in the desired position.

If the adapter element is retained in said manner, for example by means of a screw, it is advantageous that an anti-rotation element of the adapter element secures it from rotating out of the desired nominal position. Corresponding anti-rotation means can hereby take different forms and be provided on the adapter element and/or the main body of the feeder. According to an advantageous embodiment of the invention, a guide device can be provided that guides the adapter element when it is shifted in a predetermined direction. As a development of the invention, the adapter element can bear with an end face against a supporting surface, which serves as a guide, on the main body and be displaced along this surface, wherein the adapter element is secured against rotation as a result of the end face bearing against said supporting surface.

As a development of the invention, the adapter element can have a symmetrical design and have a V-shaped bevel on an end face so that in each case a limb of the V-shaped bevel can be used as a supporting surface to prevent rotation. De-pending on which side of the feeder or on which of the two positioning flanks the adapter element is mounted, sometimes one limb and other times the other limb of said V-shaped bevel is used.

In an advantageous development of the invention, said feeder is designed separately from the bill acceptor, wherein the feeder is mounted in particular on a movable housing part and/or can be integrated into the latter so that the feeder can, by moving the housing part away, be removed from the bill acceptor that is advantageously mounted inside the machine housing. In particular, the feeder can be at-attached to a pivotably mounted door so that the feeder can be removed from the bill acceptor by hinging the door open and placed in front of the bill acceptor so that it fits precisely by hinging the door closed.

BRIEF DESCRIPTION OF THE DRAWINGS

The invention is explained in detail below with the aid of a preferred exemplary embodiment and associated drawings, in which.

DETAILED DESCRIPTION

Figure 1:
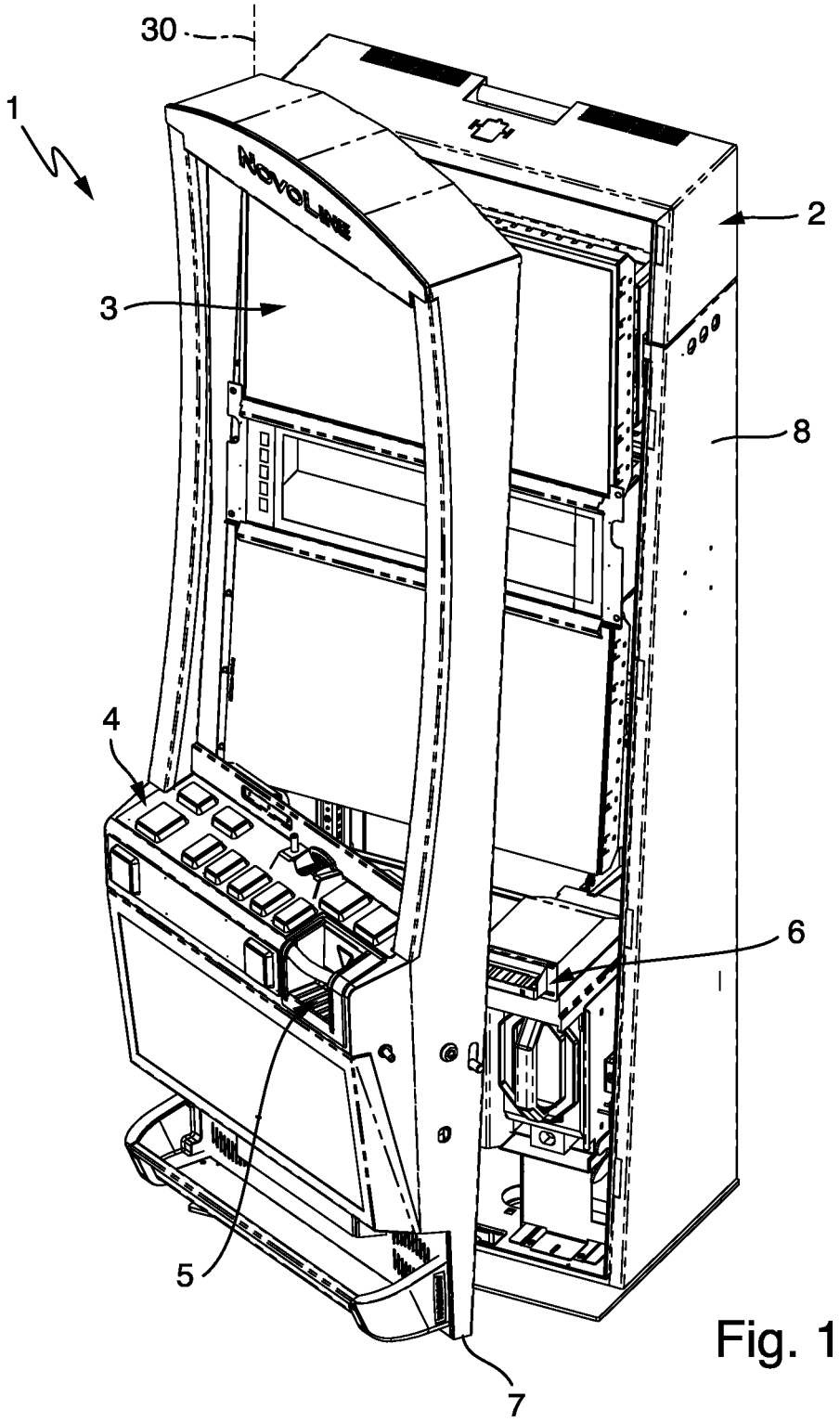
FIG. 1 shows a perspective front view of a gaming machine that comprises a machine housing with a door that can be hinged open, wherein a feeder is provided in the door in order to bank notes into a bill acceptor arranged inside the machine housing.

In the embodiment shown, the gaming machine shown in FIG. 1 is designed as a slant top machine that comprises a box-like machine housing 2 in which a display unit is provided in a fashion known per se in the form of two large screens and a display panel situated in between for displaying gaming information. A projecting operating panel section 4 is provided at the front of the machine housing 2, in a lower half, and can comprise the operating buttons for the game controls. Moreover, on the front of the machine housing 2, approximately in the region of said operating panel section 4, a feeder 5 is provided for introducing bank notes into a bill acceptor 6. Whilst said bill acceptor 6 is accommodated inside the machine housing 2, said feeder 5 lies on the outside of the machine housing 2 or into the feeder 5 integrated into a wall section of the machine housing 2. To be more precise, the feeder 5 is provided on the housing door 7 of the machine housing 2 so that the feeder 5 can be removed from the bill acceptor 6 or moved in front of the bill acceptor 6 so that it fits precisely by opening and closing the housing door 7.

In the embodiment shown in FIG. 1, said housing door 7 is articulated on the housing main body 8 so that it can be hinged about a vertical axis 30, so that said feeder 5 is hinged away from or toward the housing door 7 of the bill acceptor 6 when the latter is hinged open and shut. Said feeder 5 forms part of the housing wall of the machine housing 2 or the feeder 5 is rigidly connected to the housing wall.

Figure 2:
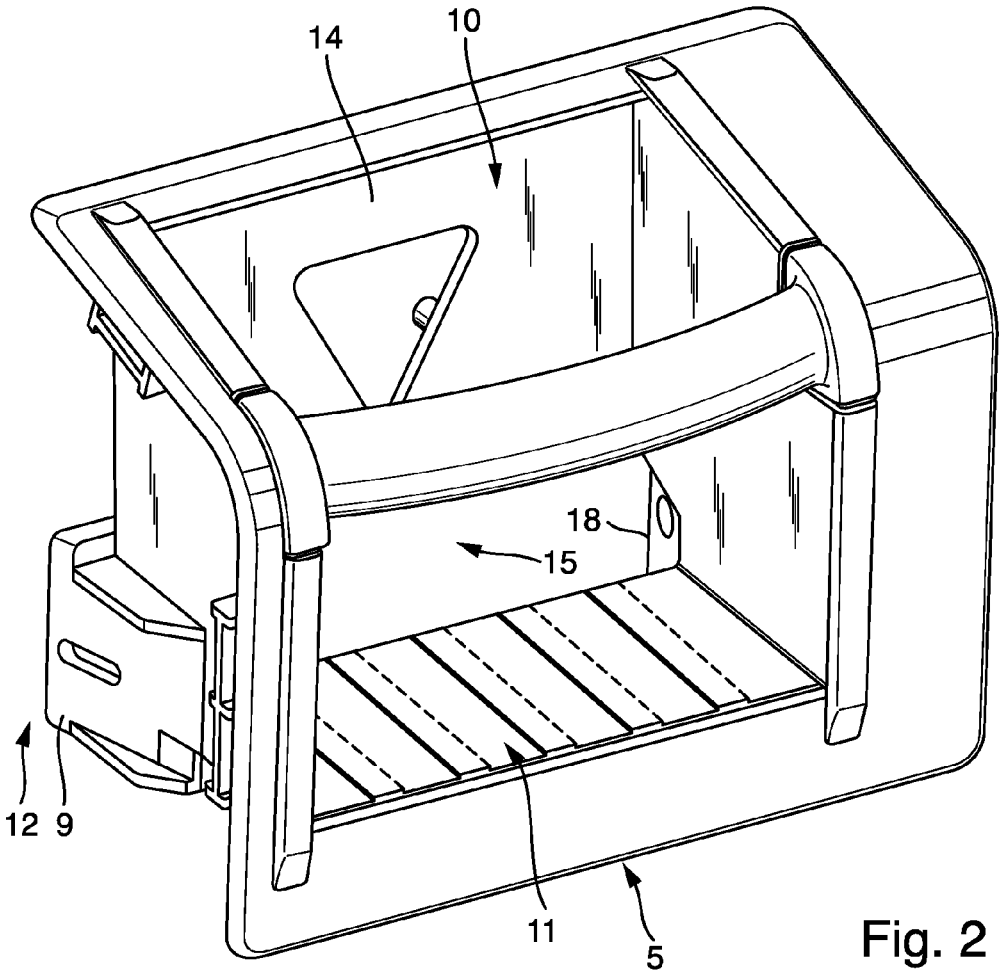
FIG. 2 shows a perspective view of the feeder on the door of the machine housing from FIG. 1.

As shown in FIGS. 1 and 2, the feeder 5 has a tray-shaped, angular main body 9 that defines a loading and holding trough 10 for inserting the bank notes.

In the embodiment illustrated, the feeder 5 hereby has a supporting surface 11 that is arranged horizontally and in the embodiment illustrated is not flat but designed with a corrugated contour. In this respect, it should be noted that the supporting surface 11 does not need to define a continuous surface and instead can, for ex-ample, take the form of a bar-shaped or lattice-like grid that, together with corresponding contour sections, forms a support for the flat side of the bank notes.

Furthermore, the supporting surface 11 can be curved and, for example, be semi-circular or in the shape of an arc so that bills held in the shape of an arc of a circle can advantageously also be easily pushed through and processed.

Moreover, the feeder 5 comprises, on its rear side facing the bill acceptor 6 and adjoining the supporting surface 11, two positioning flanks 12 and 13 that are arranged on opposite sides of the supporting surface 11, border the supporting surface 11 or an extension thereof laterally, and are oriented vertically in the embodiment illustrated.

Lastly, the abovementioned holding trough 10 is delimited at the rear by an end wall 14 that interconnects the two positioning flanks 12 and 13 and in each case extends transversely with respect to the positioning flanks 12 and 13 and the supporting surface 11. In the transition area between said end wall 14 and the abovementioned supporting surface 11, the feeder 5 has an insertion slot 15 through which the bank notes can be inserted into the bill acceptor 6 situated behind, said bill acceptor 6 having a corresponding insertion slot that comes to lie behind the insertion slot 15 of the feeder 5 so that it fits precisely and is surrounded by said positioning flanks 12 and 13.

As shown in FIGS. 3 to 7, the lateral positioning flanks 12 and 13 of the feeder 5 comprise a discharge area 16 in which said positioning flanks 12 and 13 are widened in a V-shape or funnel shape. By virtue of the fact that this discharge area 16 tapers toward the insertion slot 15, the bill acceptor 6 can be easily threaded into the feeder 5.

Respective lamellar adapter elements 17 and 18 that form the supporting contour of the positioning flanks 12 and 13 for the bank notes to be positioned and the bill acceptor 6 to be connected are provided on the main body 9 of the respective positioning flanks 12 and 13, in said discharge area 16. Said adapter elements 17 and 18 form the facing inner contours of the positioning flanks 12 and 13 between which the bank notes can be inserted.

In the embodiment illustrated, said adapter elements 17 and 18 are lamellar and in particular are designed in the form of flat plates with an essentially uniform thick-ness, wherein in an alternative embodiment, however, tapering face-shaped adapter elements can also be provided.

Said adapter elements 17 and 18 are each seated flat, by way of a rear side that forms a mounting surface of the adapter elements 17 and 18, on a mounting surface 19 or 20 designed on the main body 9 of the positioning flanks 12 and 13 so that the adapter elements 17 and 18 rest flush against them.

Figure 3:
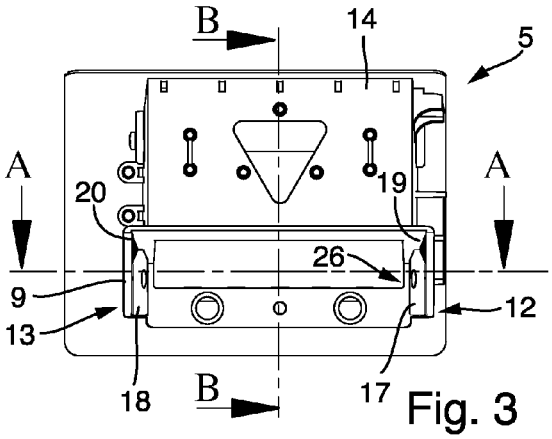
FIG. 3 shows a rear view of the feeder from FIGS. 1 and 2, viewed in an opposite direction to the direction of insertion of the bank notes.
Figure 5:
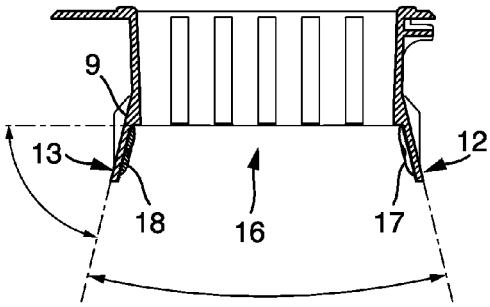
FIG. 5 shows a view in cross-section of the feeder from the preceding figures, along the line A-A in FIG. 3, which shows the contouring of the lateral profile edges and the lamellar adapter elements attached thereto.

As shown in FIGS. 3 and 5, said mounting surface 19 and 20 of the main body 9 is an inclined surface that is inclined at an acute angle with respect to the direction of insertion of the bank notes and widens toward the bill acceptor, as shown in FIG. 5. The internal width between the two adapter elements 17 and 18 can consequently be varied by displacing said adapter elements 17 and 18 on said inclined mounting surfaces 19 and 20. If the adapter elements 17 and 18 are displaced further toward the supporting surface 11 of the feeder 5, the spacing between the adapter elements 17 and 18 becomes smaller, whilst the internal width conversely becomes greater when the adapter elements 17 and 18 are displaced away from the supporting surface 11 and toward the bill acceptor 6. This is apparent from a comparison of FIGS. 3 and 8 or FIGS. 5 and 9, wherein in each case only the right-hand adapter element is displaced.

Figure 6:
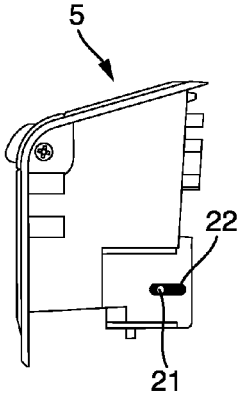
FIG. 6 shows a side view of the feeder from FIG. 3.
Figure 4:
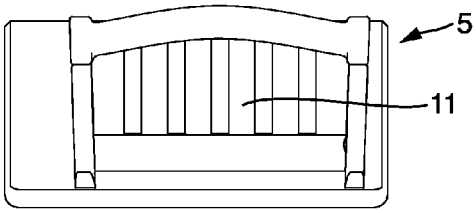
FIG. 4 shows a plan view of the feeder from FIG. 3, viewed in a direction perpendicular to the supporting surface for supporting the bank notes.

In order to be able to fix the adapter elements 17 and 18 in the respective desired position, in the embodiment illustrated the adapter elements 17 and 18 can each be clamped to the respective mounting surface 19 or 20 of the main body 9 using a tensioning element 21 in the form of a screw. In order to enable stepless setting, said tensioning element 21 is guided displaceably in an elongated hole 22 that is provided in the main body 9 of the feeder 5 in the embodiment illustrated but can also be provided in the respective adapter element 17 and 18. As shown in FIG. 6, said elongated hole 22 extends in the same direction in which it is desired for the adapter element 17 and 18 to be shifted and in particular in the direction of the in-cline of the mounting surfaces 19 and 20.

Figure 11:
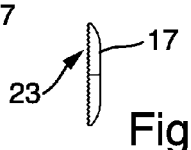
FIG. 11 shows a front view of the adapter element from FIG. 10, which shows a corrugated or toothed surface profiling of the mounting surface of the adapter element.
Figure 8:
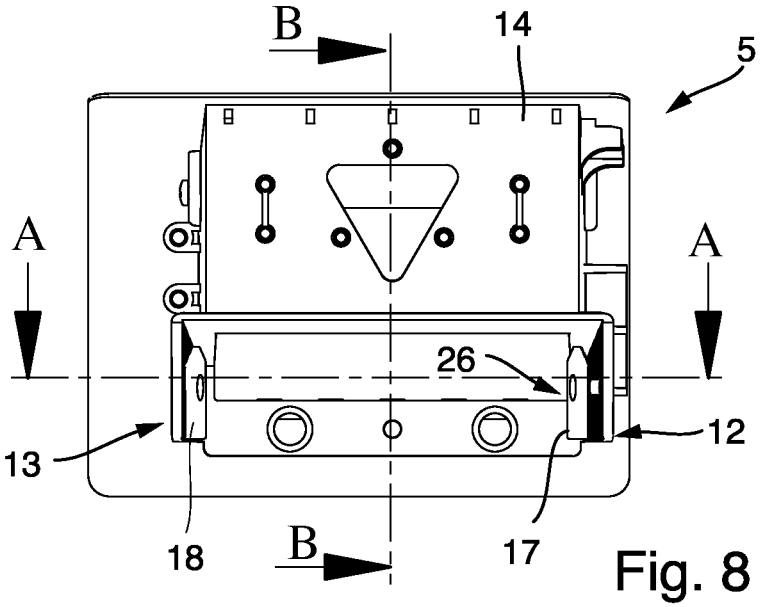
FIG. 8 shows a rear view of the feeder similar to FIG. 3 which, in contrast to FIG. 3, shows a right-hand adapter element in an adjusted position, which means a smaller internal width between the lateral profile edges.
Figure 9:
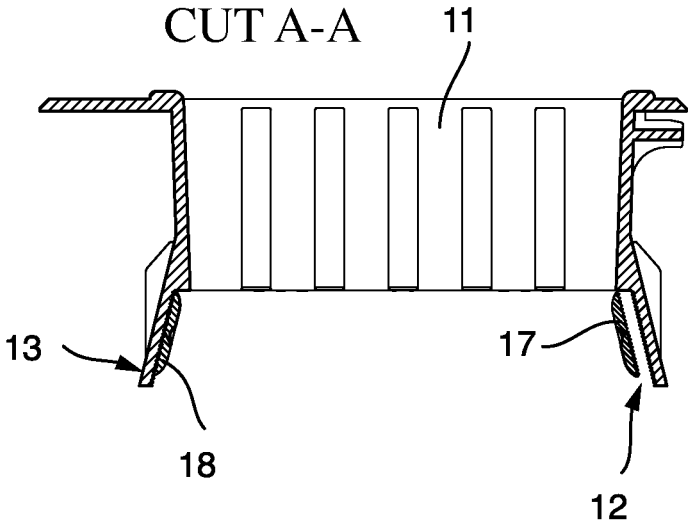
FIG. 9 shows a view in cross-section of the feeder from the preceding figures, along the line A-A in FIG. 8, which shows the right-hand adapter element in a position adjusted further inward.

In order to prevent undesired slipping of the adapter elements 17 and 18 on the main body 9 when the tensioning elements 21 are only lightly tightened, a surface profiling 23 is advantageously provided on at least one of the engaging surfaces of the adapter elements 17 and 18 and of the main body 9 and can advantageously be designed in the form of corrugations or teeth. The surface profiling 23 is advantageously thus oriented in such a way that it counteracts slipping toward said elongated hole 22. To this effect, the surface profiling 23 can advantageously have longitudinal corrugations or rows of teeth that extend transversely with respect to the elongated hole 22. As shown in FIG. 11, the adapter element 17 and 18 can in particular be provided with longitudinal teeth.

Figure 7:
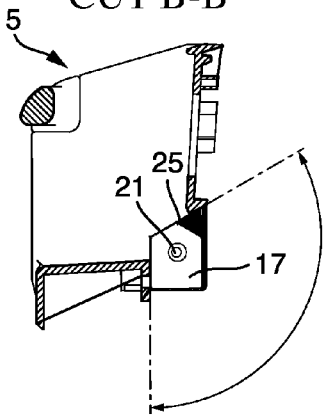
FIG. 7 shows a view in cross-section of the feeder from the preceding figures, along the line B-B in FIG. 3, which shows how the adapter element bears with a limb of its V-shaped bevel against a supporting surface of the main body of the feeder.
Figure 10:
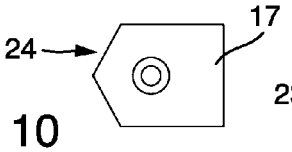
FIG. 10 shows a plan view of one of the adapter elements for setting the internal width between the lateral profile edges of the feeder.

In order to retain the adapter elements 17 and 18 in a desired rotational orientation when the adapter elements 17 and 18 are displaced on the inclined mounting surfaces 19 and 20 of the positioning flanks 12 and 13, said adapter elements 17 and 18 bear with an end side against a guide contour on the main body 9 that can be designed in the form of a projection transversely from the inclined mounting surfaces 19 and 20 (FIG. 3 and FIG. 7). In particular, the adapter elements 17 and 18 can be provided on an end side with a V-shaped bevel 24 so that in each case a limb of said V-shaped bevel 24 comes to be supported on the main body 9 on the guide contour 25 that extends obliquely in a corresponding fashion (FIG. 3 and FIG. 7). Because the adapter elements 17 and 18 have a symmetrical design, it is possible to use just one type of adapter element 17 and 18 on both sides of the feeder 5, i.e. by reversing the adapter element it can be mounted sometimes on the right-hand side and other times on the left-hand side of the feeder 5, wherein a respective other limb of said V-shaped bevel 24 comes to be supported on the guide contour 25 of the main body 9.

What is claimed is:

1. A gaming machine comprising:

a housing including a bill acceptor facing outwardly therefrom;

a door attached to the housing and moveable between an open position and a closed position; and a feeder disposed within an opening in the door and configured to engage with a portion of the bill acceptor when the door is closed, the feeder including a bill acceptor receiving portion disposed on an interior side of the feeder and having a pair of opposing lateral positioning flanks that expand away from each other in a direction towards the bill acceptor, and a pair of adapter elements, each adapter element being attached to one of the flanks and adjustably affixed along a length of the flank to change the distance between the adapter elements so that the bill acceptor receiving portion can be adjusted to connect with a plurality of different sized bill acceptors.

2. The gaming machine of claim 1 wherein one of each lateral positioning flank and each adapter element defines a slot and wherein each adapter element is secured to the flank by a fastener received through the slot.

3. The gaming machine of claim 1 wherein each lateral positioning flank includes a mounting surface and wherein each adapter element is disposed against one of the mounting surfaces.

4. The gaming machine of claim 3 wherein the mounting surfaces and the adapter elements each include surface profiling to prevent slippage between the mounting surfaces and the adapter elements.

5. The gaming machine of claim 4 wherein the surface profiling is a corrugated surface.

6. The gaming machine of claim 1 wherein the bill acceptor receiving portion further comprises a bill slot disposed between the lateral positioning flanks.

7. The gaming machine of claim 1 wherein the lateral positioning flanks each taper outwardly from a centerline of the bill acceptor at 5 to 30 degrees.

8. The gaming machine of claim 1 wherein the lateral positioning flanks each taper outwardly from a centerline of the bill acceptor at 10 to 20 degrees.

9. A gaming machine bill feeder disposed within a door of a gaming machine and configured to engage with a portion of a bill acceptor, the feeder comprising:

a bill acceptor receiving portion disposed on an interior side of the feeder and including a pair of opposing lateral positioning flanks that expand away from each other in a direction towards the bill acceptor; and a pair of adapter elements, each adapter element being attached to one of the flanks and adjustably affixed along a length of the flank to change the distance between the adapter elements so that the bill acceptor receiving portion can be adjusted to connect with a plurality of different sized bill acceptors.

10. The feeder of claim 9 wherein one of each lateral positioning flank and adapter each element defines a slot and wherein each adapter element is secured to the flank by a fastener received through the slot.

11. The feeder of claim 9 wherein each lateral positioning flank includes a mounting surface and wherein each adapter element is disposed against one of the mounting surfaces.

12. The feeder of claim 11 wherein the mounting surfaces and the adapter elements each include surface profiling to prevent slippage between the mounting surfaces and the adapter elements.

13. The feeder of claim 12 wherein the surface profiling is a corrugated surface.

14. The feeder of claim 9 wherein the bill acceptor receiving portion further comprises a bill slot disposed between the lateral positioning flanks.

15. The feeder of claim 9 wherein the lateral positioning flanks each taper outwardly from a centerline of the bill acceptor at 5 to 30 degrees.

16. The feeder of claim 9 wherein the lateral positioning flanks each taper outwardly from a centerline of the bill acceptor at 10 to 20 degrees.

* * * * *

UNITED STATES PATENT AND TRADEMARK OFFICE

CERTIFICATE OF CORRECTION

PATENT NO. : 9,230,384 B2
APPLICATION NO. : 14/457263
DATED : January 5, 2016
INVENTOR(S) : Marek Gawel et al.

It is certified that error appears in the above-identified patent and that said Letters Patent is hereby corrected as shown below:

Claims

Column 8, Line 65, Claim 10:

After "positioning flank"
Delete "and adapter each element"

Signed and Sealed this
Twenty-sixth Day of April, 2016

Michelle K. Lee

Michelle K. Lee
*Director of the United States Patent and Trademark Office*